US007422011B2

(12) United States Patent
Bachinski et al.

(10) Patent No.: US 7,422,011 B2
(45) Date of Patent: Sep. 9, 2008

(54) FIREPLACE FRONT PANEL ASSEMBLY FOR REDUCING TEMPERATURE

(75) Inventors: Thomas J. Bachinski, Lakeville, MN (US); Gary Lee Butler, Silver Lake, MN (US); Robert S. Waddell, Faribault, MN (US); Dennis R. Maiello, Apple Valley, MN (US); Steven G. Smith, Lakeville, MN (US); Paul J. Gross, Lake City, MN (US)

(73) Assignee: HNI Technologies, Inc., Muscatine, IA (US)

( * ) Notice: Subject to any disclaimer, the term of this patent is extended or adjusted under 35 U.S.C. 154(b) by 270 days.

(21) Appl. No.: 11/067,412

(22) Filed: Feb. 22, 2005

(65) Prior Publication Data

US 2006/0185666 A1 Aug. 24, 2006

(51) Int. Cl.
*F24B 1/189* (2006.01)
*F24B 1/188* (2006.01)

(52) U.S. Cl. ..... 126/521; 126/523; 126/533; 126/193; 126/110 E

(58) Field of Classification Search ..... 126/521, 126/523, 533, 110 A, 110 E, 198, 193
See application file for complete search history.

(56) References Cited

U.S. PATENT DOCUMENTS

| | | | | |
|---|---|---|---|---|
| 2,747,568 | A | 5/1956 | Dupler | |
| 2,794,434 | A | 6/1957 | Evans | |
| 3,489,135 | A | 1/1970 | Astrella | |
| 3,616,788 | A | 11/1971 | Hannebaum | |
| 3,889,099 | A | 6/1975 | Nuss | |
| 4,033,321 | A | 7/1977 | Krebs | |
| 4,282,855 | A | 8/1981 | Perry | |
| 4,412,524 | A | 11/1983 | Ratelband | |
| 4,519,377 | A | 5/1985 | Taylor | |
| 4,541,408 | A | 9/1985 | Ratelband | |
| 4,607,612 | A | 8/1986 | DeRisi | |
| 4,616,628 | A | 10/1986 | Ratelband | |
| 4,686,891 | A | 8/1987 | Pouchard | |
| 5,337,727 | A | 8/1994 | Borens et al. | |
| 5,339,797 | A | 8/1994 | Maitland | |
| 5,542,407 | A | 8/1996 | Hawkinson | |
| 5,960,789 | A * | 10/1999 | Fleming | 126/512 |
| 6,019,099 | A | 2/2000 | Shimek et al. | |
| 6,053,165 | A | 4/2000 | Butler et al. | |
| 6,736,133 | B2 | 5/2004 | Bachinski et al. | |
| 6,748,942 | B2 | 6/2004 | Bachinski et al. | |
| 6,848,441 | B2 | 2/2005 | Bachinski et al. | |
| 2003/0049575 | A1 | 3/2003 | Lyons et al. | |

FOREIGN PATENT DOCUMENTS

| | | |
|---|---|---|
| CA | 1125607 | 6/1982 |
| JP | 1-306769 | 12/1989 |

* cited by examiner

*Primary Examiner*—Alfred Basichas

(57) ABSTRACT

A heating appliance includes an outer enclosure including a transparent front panel, a combustion chamber enclosure, and a variable speed blower. The combustion chamber enclosure is positioned within the outer enclosure and defines a combustion chamber wherein radiant heat is generated. The combustion chamber enclosure also includes a transparent front panel. The blower is configured to generate an adjustable airflow between the outer enclosure front panel and the combustion chamber enclosure front panel and to exhaust the airflow to a remote location. The airflow absorbs at least some of the radiant heat and varying a speed of the blower controls an amount of radiant heat transferred from the combustion chamber to a living space in which the heating appliance is exposed.

24 Claims, 12 Drawing Sheets

FIREPLACE FRONT PANEL ASSEMBLY FOR REDUCING TEMPERATURE

BACKGROUND OF THE INVENTION

1. Field of the Invention

The present invention generally relates to heat generating appliances, and more specifically relates to systems and methods of cooling exposed surfaces of a heat-generating appliance.

2. Related Art

Heating appliances such as fireplaces, stoves and fireplace inserts have become increasingly commonplace in homes, businesses, and other buildings. These and other types of heating appliances provide benefits an aesthetically pleasing arrangement of, for example, flames, sounds, and smells in addition to the generation of heat. Such heating appliances is typically mounted in a wall of a structure or directly adjacent to a wall structure and may include one or more exposed surfaces.

The exposed surfaces of the heating appliance can create safety issues. For example, because the heating appliance produces heat, it is possible for one or more of the exposed surfaces to become heated. Surfaces of a heating appliance that are typically exposed are the viewing surface or surfaces through which the interior of the fireplace is viewed and the surround which surrounds the fireplace.

The exposed surfaces may become hot and pose a risk of burns to individuals or damage to objects that come into contact with the surfaces. Current fireplace design fails to adequately provide means of maintaining the exposed surfaces of the heating appliance at a temperature that is safe.

Thus, there is a need for a system and method for cooling an exposed surface of a heating appliance.

SUMMARY OF THE INVENTION

The present invention relates to heating appliances having a reduced temperature exposed surface. One aspect of the invention relates to a heating appliance such as a fireplace, stove, or stove insert that includes an outer enclosure having a transparent front panel, a combustion chamber enclosure, and a variable speed blower. The combustion chamber enclosure is positioned within the outer enclosure and defines a combustion chamber wherein radiant heat is generated. The combustion chamber enclosure also includes a transparent front panel. The blower is configured to generate an adjustable airflow between the outer enclosure front panel and the combustion chamber enclosure front panel and to exhaust the airflow to a remote location. The airflow absorbs at least some of the radiant heat and varying a speed of the blower controls an amount of radiant heat transferred from the combustion chamber to a living space in which the heating appliance is exposed.

The heating appliance may also include an interior panel that is positioned between the front panels of the outer and combustion chamber enclosures. The interior panels defines a first air space between the interior panel and the combustion chamber enclosure front panel, and a second air space between the interior panel and the combustion chamber enclosure front panel. A first airflow passes through the first air space and a second airflow, separate from the first airflow, passes through the second air space. The first and second airflows can help reduce a temperature of the outer enclosure front panel as well as transfer radiant heat away from the heating appliance.

Another aspect of the invention relates to a method of controlling radiant heat output from a heating appliance. The heating appliance includes an outer enclosure having a transparent front panel, a combustion chamber enclosure having a transparent front panel and defining a combustion chamber, and a variable speed blower. The method includes positioning the combustion chamber enclosure within the outer enclosure, generating radiant heat in the combustion chamber enclosure, generating an airflow into and out of the outer enclosure with the blower, moving the airflow between the front panels of the outer enclosure and the combustion chamber enclosure, and varying a speed of the blower to control the amount of radiant heat transferred from the combustion chamber through the front panel of the outer enclosure.

Another method of the invention relates to a method of removing heated air from a heating appliance. The heating appliance includes an outer enclosure having a front panel, a combustion chamber enclosure having a front panel and defining a combustion chamber wherein heat is generated, an inner panel, a direct vent assembly coupled to the combustion chamber, and first and second exhaust assemblies. The method includes positioning the inner panel between the front panels of the outer enclosure and the combustion chamber enclosure, the inner panel defining first and second air chambers. The method also includes coupling the first and second exhaust assemblies to respective first and second air chambers and providing a source of fresh air to the combustion chamber and exhausting combustion gases from the combustion chamber with the direct vent assembly. The method may further include removing heated air from the first air chamber with the first vent assembly and removing heated air from the second air chamber with the second vent assembly.

A still further aspect of the invention relates to a panel assembly suited for use with a heating appliance. The panel assembly includes a pair of panels spaced apart in parallel orientation to define an air plenum, wherein one of the panels provides an exposed surface of the heating appliance and the air plenum is fluidly separated from a combustion chamber of the heating appliance and a living space in which the heating appliance is exposed. The panel assembly also includes a variable speed blower configured to remove heat from the air plenum and exhaust the removed heat to a location remote from the heating appliance.

The above summary of the present invention is not intended to describe each disclosed embodiment or every implementation of the present invention. In particular, the example embodiments described below in relation to the Figures are the application of the present invention in a fireplace, whereas many other fields may be applicable to fulfill the purposes and intents of the present invention. Figures in the detailed description that follow more particularly exemplify certain embodiments of the invention. While certain embodiments will be illustrated and describe embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

Figure 1:
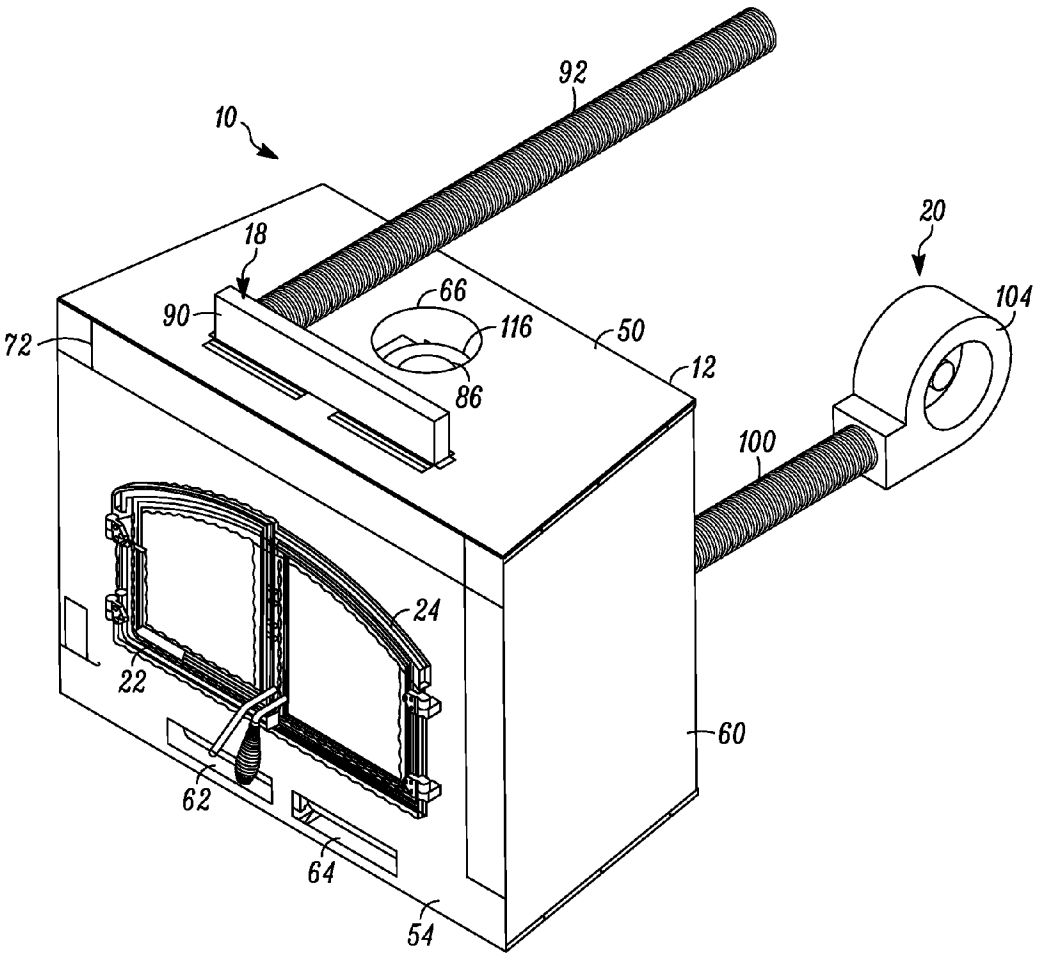
FIG. 1 is a front perspective view of an example fireplace assembly according to principles of the present invention.
Figure 2:
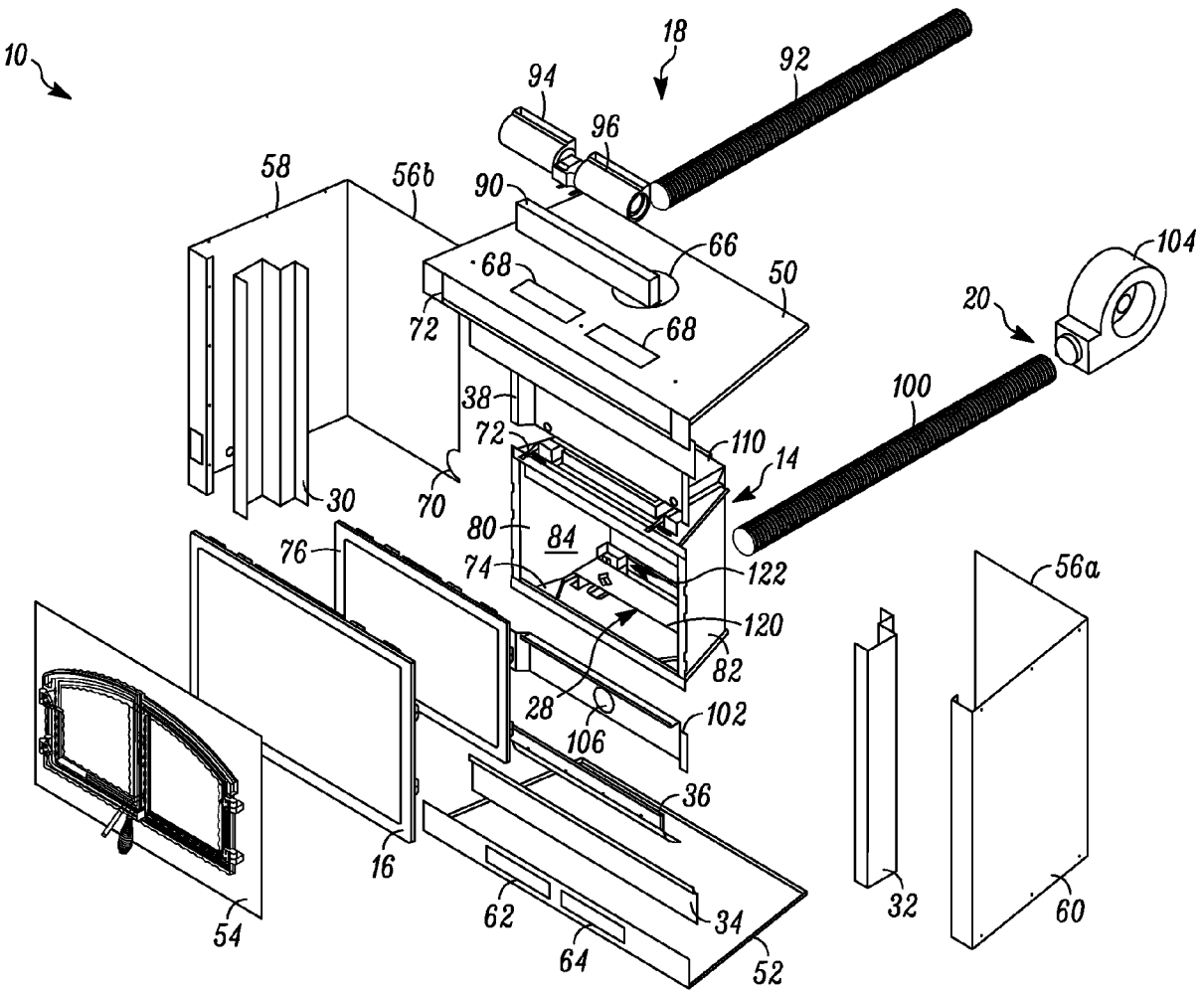
FIG. 2 is an exploded perspective view of the fireplace assembly shown in FIG. 1.
Figure 3:
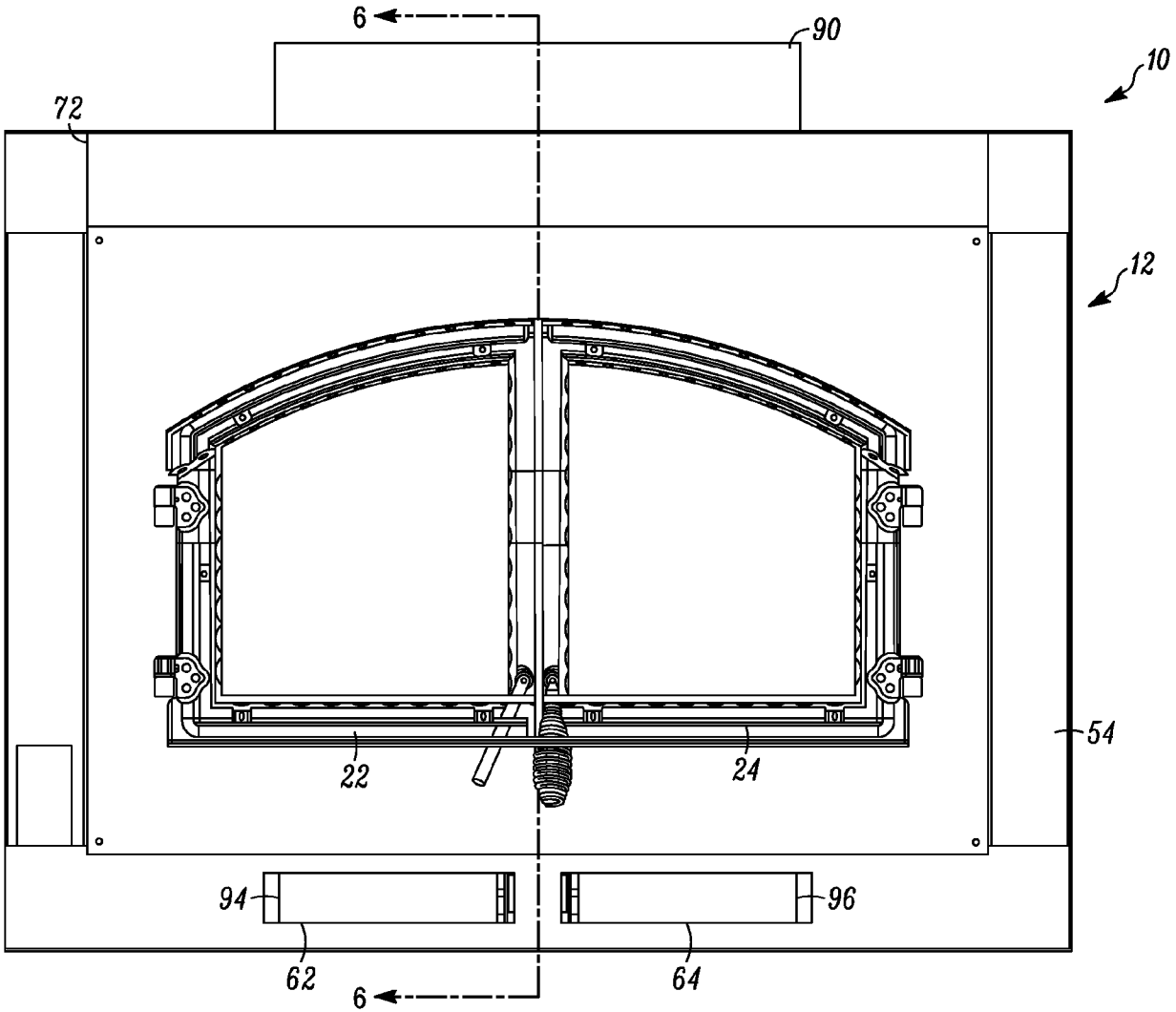
FIG. 3 is top view of the fireplace assembly shown in FIG. 1.
Figure 4:
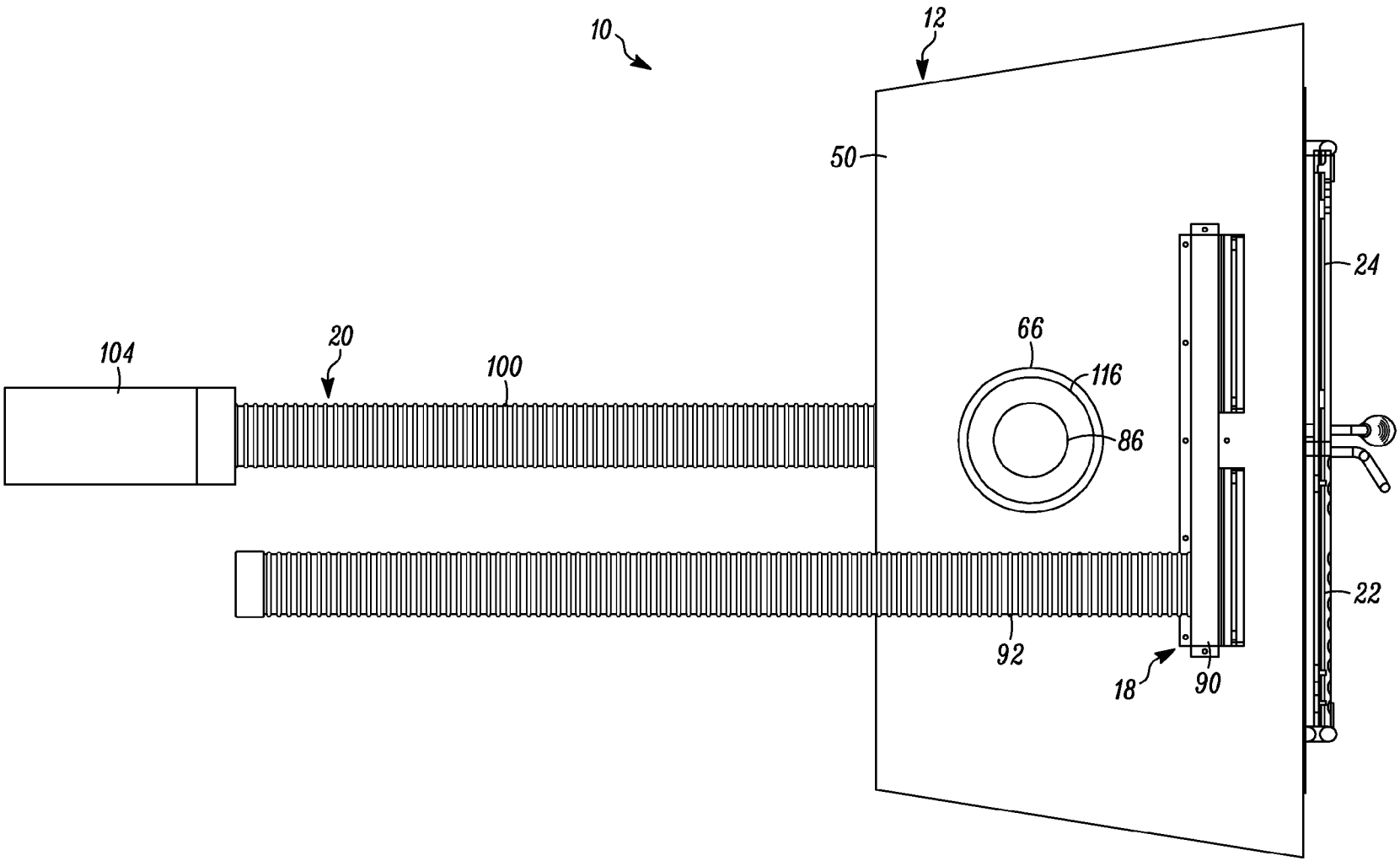
FIG. 4 is a front view of the fireplace assembly shown in FIG. 1.
Figure 5:
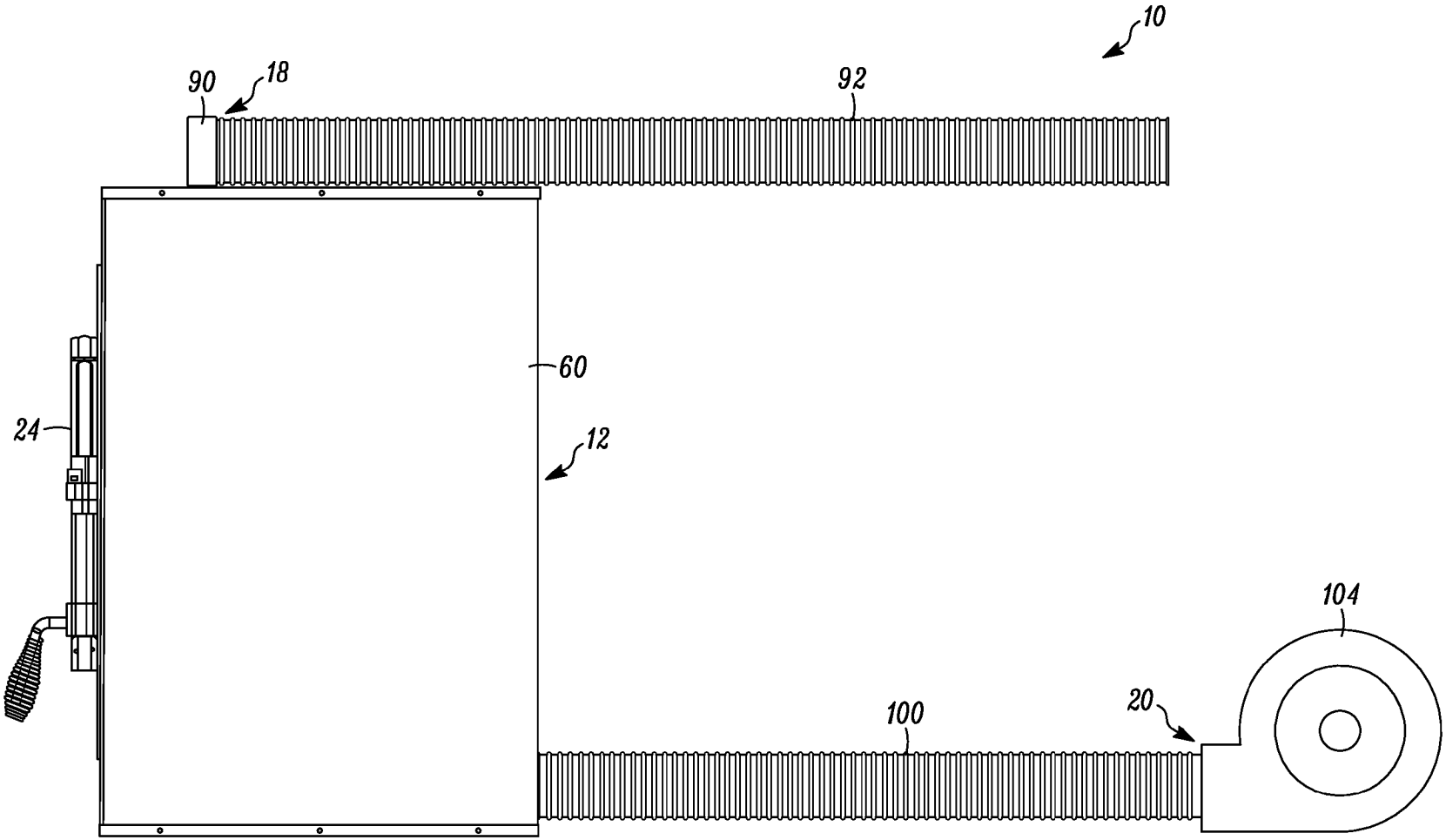
FIG. 5 is a side view of the fireplace assembly shown in FIG. 1.
Figure 6:
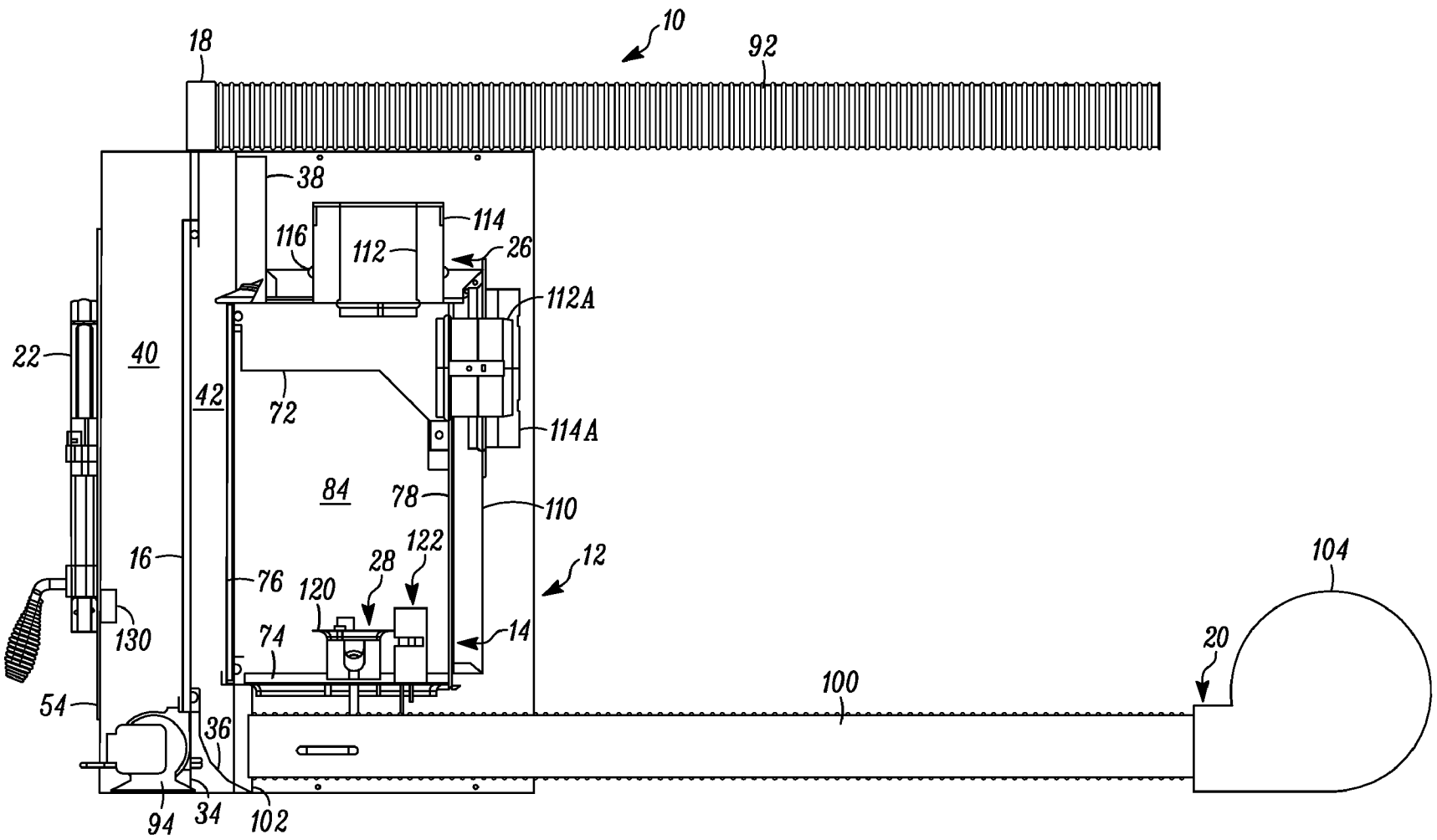
FIG. 6 is a cross-sectional view of the fireplace assembly shown in FIG. 4 taken along cross-sectional indicators 6-6.
Figure 7:
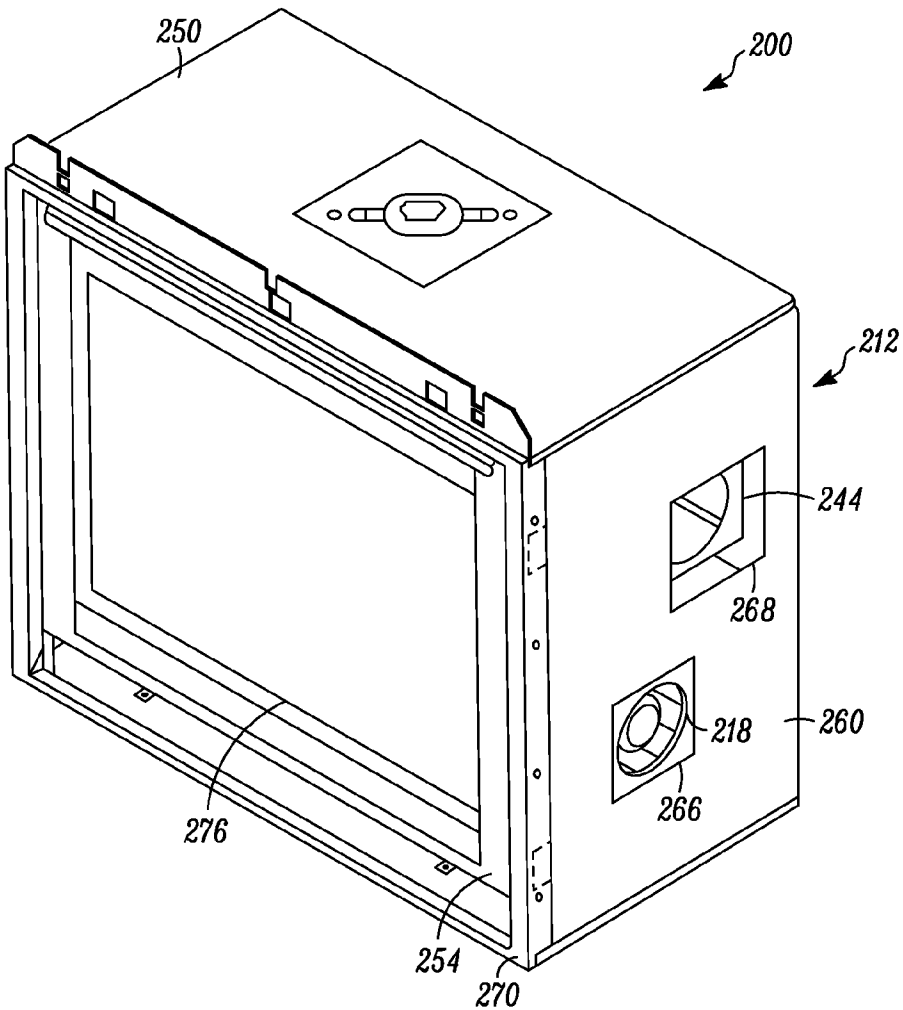
FIG. 7 is a front perspective view of another example fireplace assembly according to principles of the present invention.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention generally relates to heating appliances, and more specifically relates to systems and methods of cooling exposed surfaces of a heating appliance and directing heat generated by the heating appliance away from the appliance. The heating appliance may include a double air wash assembly that provides at least two layers of circulating air between the exposed front panel of the appliance outer enclosure and the front panel of a combustion chamber enclosure positioned within the outer enclosure. These layers of air may be heated by heat generated in the combustion chamber. The heated air is then exhausted from the outer enclosure. The appliance includes blowers or other air moving devices that circulate the layers of air at a selected rate to optimize the amount of heat transfer for a given amount of heat generated in the combustion chamber in order to maintain a certain temperature for the appliance exposed surface. The heating appliance may also include a separate venting assembly for providing fresh combustion air to the combustion chamber and exhausting combustion gases from the combustion chamber.

A central aspect of the invention relates to controlling the amount of radiant heat provided to a living space by the heating appliance. This type of radiant heat control is possible by varying a blower speed thereby altering the rate of air moving between the front panels of the heating appliance and the combustion chamber of the heating appliance. This radiant heat control is possible without altering the amount of radiant heat being produced by the heating appliance. As a result, it is possible to provide a whatever fire display desired within the heating appliance while separately controlling the amount of radiant heat (and other heat) that enters the living space wherein the heating appliance is exposed.

As used herein, the term "combustion chamber enclosure" may be any structure that at least partially surrounds that portion of the heating appliance in which combustion or heat generation occurs. A combustion chamber enclosure typically includes a plurality of panels that define a combustion chamber for the combustion of fuel or generation of heat using other means. The phrase "living space" will be understood to mean the interior or inner portion of any dwelling structure, such as a house or office building that at least partially protects from the elements. The term "room" is defined as an area of the living space in which the heating appliance resides. The phrase "outside of a living space" will be understood to mean the exterior or outer portion of a dwelling structure, which is typically exposed to various weather elements such as rain, snow, wind, etc.

While the example embodiments of the present invention provided below are described in conjunction with direct vent fireplaces, the present invention is equally applicable to other heating appliances such as, for example, a universal vent, a B-vent, a horizontal/vertical-vent, a dual direct vent, and a multisided heating appliance having two or three glass panels as combustion chamber side panels. Although the present invention may be particularly useful for a fireplace, as described below, many principles of the present invention may be applied to closed front fireplaces, stoves, furnaces, fireplace inserts and similar heat generating appliances that include an otherwise heated exposed surface.

Referring now to FIGS. 1-6, an example fireplace assembly 10 that illustrates principles of the present invention is shown and described. Fireplace 10 includes an outer enclosure 12, a combustion chamber enclosure 14, an interior panel 16, first and second vent assemblies 18, 20, first and second doors 22, 24, and a direct vent assembly 26. The interior panel 16 is positioned between a front panel of the combustion chamber enclosure 14 and a front panel of the outer enclosure 12, thereby defining first and second air chambers 40, 42. Fireplace 10 also includes a burner assembly 28 positioned within the combustion chamber enclosure, and first and second side interior panel supports 30, 32, a bottom interior panel support 34, a baffle 36, and a top support member 38 all positioned within the outer enclosure 12. The supports 30, 32, 34, 38 and baffle 36 function to separate, isolate, and direct air through the first and second air chambers 40, 42.

The outer enclosure 12 includes top and bottom panels 50, 52, front and first and second rear panels 54, 56A, 56B, and first and second side panels 58, 60 that define an enclosure within which the combustion chamber enclosure 14 and other features of fireplace 10 may be positioned. First and second intake openings 62, 64 and a second exhaust opening 72 may be formed in the front panel 54 to provide for airflow through the first air chamber 40. A direct vent opening 66 may be formed in the top panel 52 to provide access for the direct vent assembly 26 to engage the combustion chamber enclosure 14. A first exhaust opening 68 that is also formed in the top panel 50 provides airflow between the second air chamber 42 and the first vent assembly 18. A third intake opening 70 defined by the first and second rear panels 56A, 56B provides for airflow between the second air chamber 42 and the second vent assembly 20.

The outer enclosure 12 is shown in the Figures as being constructed of several independent panels that are secured together in the shape of a rectangular box. Other embodiments may include different shaped outer enclosures or outer enclosures with multiple panels formed together as a unitary piece. Further, the outer enclosure may have intake and exhaust openings formed in different panels than those shown in the Figures. For example, the direct vent opening may be positioned on one of the side or rear panels, or the fireplace may include a co-linear exhaust system rather than a direct vent opening such that two separate openings are required for providing fresh combustion air and removal of combustion gases from the fireplace combustion chamber enclosure 14.

The combustion chamber enclosure 14 may include top and bottom panels 72, 74, front and rear panels 76, 78, and first and second side panels 80, 82 that together define a combustion chamber 84. Combustion chamber enclosure 14 may also include an exhaust opening 86 formed in the top panel 72. The bottom panel 74 may include a plurality of combustion air intake openings (not shown) for communication of combustion air from the direct vent assembly 26 into the combustion chamber 84 for the combustion of fuel at the burner assembly 28.

The combustion chamber enclosure 14 is shown in the Figures as a generally rectangular shaped box defined by the plurality of panels 72, 74, 76, 78, 80, 82. Other embodiments may include different shapes, sizes and configurations for the combustion chamber enclosure. Some embodiments may include a combustion chamber enclosure that is formed as a single unitary body (with exception of the removable front panel) using, for example, a molded material such as a ceramic fiber and a binder. Such molded materials may be used to form the combustion chamber enclosure using such molding techniques as compression molding, vacuum molding, or casting as described in U.S. Publication No. 2003/0049575 A1, which is incorporated herein by reference.

The first vent assembly 18 includes an air collection enclosure 90 and a first duct 92. The air collection enclosure 90 is positioned over the first exhaust openings 68 thereby providing fluid communication with the first air chamber 40. The enclosure 90 may be shaped to cover any configuration for openings 68. In other embodiments, the first duct 92 may be coupled individually to the openings 68.

The second vent assembly 20 includes a second duct 100, a second duct support 102 positioned beneath the combustion chamber enclosure 14, an aperture 106 formed in the second duct support 102, and a blower 104. The blower 104 may be configured to force a source of fresh air through the second duct 100 into the second air chamber 42 and then out of the first vent assembly 18. In other embodiments, the blower 104 may be configured to create a vacuum force that draws air into the second air chamber 42 through the first vent assembly and back out of the second duct 100. The blower 104 may be positioned at a remote location from the outer enclosure 12, or may be positioned within the outer enclosure 12. Advantages of positioning the blower at a remote location include a reduction in blower noise heard by a user positioned at the front panel 54, and a reduced size requirement for the fireplace outer enclosure that is otherwise required if the blower is positioned therein.

The blower 104 may be coupled to a source of fresh, outside air or any other source of air that has a temperature lower than the temperature of air within the outer enclosure 12. Using air that is relatively cool compared to the temperature of air in the air chambers 40, 42 and panels of the combustion chamber enclosure 14 improves the heat transfer away from the combustion chamber enclosure 14.

In the illustrated embodiment, the second duct 100 extends underneath the combustion chamber enclosure 14 and through the aperture 106 in the second duct support 102 so as to provide fluid communication directly with the isolated second air chamber 42. The second air chamber 42 extends along the front surface of the combustion chamber enclosure 14 and is not in fluid communication with the first air chamber 40, or the air plenum defined between the outer enclosure 12 and the top, sides, and rear surfaces of the combustion chamber enclosure 14. In other embodiments, the second air chamber 42 may have different shapes and sizes and may extend around other surfaces of the combustion chamber enclosure besides the front panel surface only. In such embodiments, the second duct 100 may be repositioned to be coupled to an outer surface of the outer enclosure 12 such as, for example, the top, sides, or rear panels of the outer enclosure 12 rather than extending under the combustion chamber enclosure 14.

The baffle 36 positioned in the second air chamber 42 may assist in directing air in the second air chamber 42 into or out of the second duct 100. The first and second side interior panel supports 30, 32 and the bottom interior panel support 34 along with the second duct support 102 may be used to further define the second air chamber 42 between the outer enclosure panels, the interior panel 16, and the combustion chamber enclosure panels. These various supports may be positioned in alternative locations within the outer enclosure 12 to redefine the shape and size of the first and second air chambers 40, 42.

The first air chamber 40 is defined between the interior panel 16 and the front panel 54 and doors 22, 24 positioned at the front of the outer enclosure 12. Access to the first air chamber 40 is provided through the first and second intake openings 62, 64 positioned along a bottom side of the doors 22, 24, an outlet or a second exhaust opening 72 positioned above the doors 22, 24, and through the doors 22, 24 themselves. One way in which heat generated in the combustion chamber enclosure 14 can be further removed from the outer enclosure 12 to maintain a reduced temperature of the exposed front surfaces of the outer enclosure (e.g., the front panel 54 and doors 22, 24) is to operate a pair of first and second blowers 94, 96 that circulates air through the first air chamber 40. The blowers 94, 96 are shown positioned along the bottom panel 52 of the outer enclosure in alignment with the first and second intake openings 62, 64. The blowers 94, 96, draw air into the first air chamber 40 through the intake openings 62, 64, and force air out of the second exhaust opening 72. The flow of air through the first air chamber is heated and then forced out of the fireplace 10 in a direction away from the exposed surfaces of the fireplace 10. Even when the blowers 94, 96 are not in operation, a natural convection occurs within first air chamber 40 as heated air exits the second exhaust opening 72 creating a draft that draws in relatively cool air through the first and second intake openings 62, 64. Directing blown air from blowers 94, 96 onto the doors 22, 24 and front panel 54 may enhance transfer of heat from those surfaces into the flow of air and improve heat transfer efficiency.

Another way of transferring heated air out of the first air chamber 40 is to open the doors 22, 24. Opening the doors 22, 24 may further enhance the transfer of radiant, infrared, ultraviolet, and other types of heat generated by the burner assembly 28 and the combustion chamber enclosure 14 directly out into the living space rather than heating the doors 22, 24 and the front panel 54.

Opening and closing of the doors may be automated or mechanically operated using a motor or other automated means. An example automated system of opening doors is disclosed in U.S. patent application Ser. No. 10/794,424 entitled AUTOMATIC DOORS FOR A FIREPLACE and filed on Mar. 5, 2004, which is incorporated herein by reference. Opening or closing the doors 22, 24 may affect the amount of radiant heat being passed into the living space. The extent to which the doors are open or closed may also affect how the radiant heat is directed into the living space. For example, for two persons sitting side-by-side in front of the fireplace, opening or closing the doors 22, 24 can customize the amount of radiant heat felt by each person.

The fireplace 10 may further include and on/off switch 130 associated with one or more of the doors 22, 24 that controls operation of the first and second blowers 94, 96 upon opening or closing the doors 22, 24. In some embodiments, opening one or more of the doors 22, 24 eliminates the need to operate the blowers 94, 96 for transferring heat out of the first air chamber 40. In some embodiments, opening one or more of the doors 22, 24 while the blowers 94, 96 are operating may provide for undesired amounts of blower noise to the user or may provide excessive airflow out of the doors 22, 24. The on/off switch 130 may automatically turn the blowers 94, 96 on or off depending on an open or closed position of the doors 22, 24.

The direct vent assembly 26 may include a fresh air chamber 110, exhaust vent 112, a fresh air vent 114 and a combustion air opening 116. The fresh air chamber 110 extends from the top of the combustion chamber enclosure 14 where the fresh air vent 114 engages to around the rear panel 78 to a location where a combustion air opening is provided into the combustion chamber 84 adjacent to the burner assembly 28. The rear or bottom panel 78, 74 or the side panels 80, 82 may include the air openings into the combustion chamber 84 depending of the configuration of the fresh air chamber 110 and other features of the fireplace 10.

The exhaust vent 112 extends coaxially with the fresh air vent 114 and passes through the exhaust opening 86 formed in the top panel 72 to provide an exhaust path for combustion gases and heated air within the combustion chamber 84. Preferably, a direct vent duct is coupled to the exhaust and fresh air vents 112, 114 and extends out of the direct air vent opening 66 in the top panel 50 of the outer enclosure 12. An auxiliary exhaust vent 112A and an auxiliary fresh air vent 114A may be provided along the rear panel 78 of the combustion chamber enclosure for coupling of a direct vent duct through a rear panel of the outer enclosure 12 for horizontal direct venting rather than vertical direct venting. As noted above, alternative venting structures may be used such as B-vents, co-linear venting, and other venting arrangements to provide exhaustion of combustion gases and provide a source of fresh combustion air for the combustion chamber 84.

The burner assembly 28 may include a burner plate 120 and an ignition assembly 122. The ignition assembly 122 provides a pilot light and other ignition features that light the burner plate for the production of heat within the combustion chamber 84.

The illustrated embodiment provides for first and second air chambers 40, 42 that are sealed from each other. Such separate air chambers permits individualized control of venting from each of these air chambers. Thus, different rates of airflow may be possible in each air chamber to optimize the heat transfer to meet predetermined temperatures of the exposed features of the fireplace (e.g., the doors 22, 24 and front panel 54 of the outer enclosure 12). Optimizing the heat transfer may be dependent on the temperature of the cool air provided to the first and second air chambers 40, 42. For example, if the second vent assembly 20 is coupled to a source of cool air outside of the building structure, that source of air may vary widely in temperature depending on the time of day or the day of the year. Depending on the temperature of that source of outside air, the blower may be adjusted to provide a reduced or an increased airflow rate to alter the amount of heat transfer provided by the second air chamber 42. Likewise, the blowers 94, 96 may be adjusted in rate depending on the room temperature in the room from which they draw air into the first air chamber 40.

In still further embodiments, an adjustable opening may be provided between the first and second air chambers so as to alter where the first and second air chambers exhaust heated air and/or from what source of cool air is air drawn into the first and second air chambers. In one example, it may be possible to close one or more of the intake openings 62, 64 and provide cool fresh air into the first air chamber from a remote location such as, for example, cool air provided by the second vent assembly 20. In other embodiments, the second exhaust opening 72 may be restricted or covered and the heated air in first air chamber 40 may be exhausted to a different location such as, for example, through the first vent assembly 18, or into the direct vent exhaust vent 112. Any number of variations for the intake of cool fresh air and exhaust of heated air from the first and second air chambers 40, 42 is possible to provide a desired heat transfer effect to reduce the temperature of an exposed surface of the fireplace 10.

Using different sources for the intake and exhaust of heated air related to the first and second air chamber 40, 42 can also influence a pressure condition in the living structure towards a positive or a negative pressure. A recommended pressure condition for a living structure relates to the amount of air entering or leaving the living structure. In one example, about 50 to 100 cubic feet per minute (cfm) either entering or leaving a living structure at any given time is preferred. The fireplace 10 may help to optimized the pressure condition in the living structure by altering the intake and exhaust sources for the airflow in the chambers 40, 42.

Another way in which the fireplace 10 may be modified to further increase heat transfer so as to maintain a reduced temperature of exposed surfaces of the fireplace 10 is to exhaust heated air out of the fireplace that is positioned within the plenum defined between the outer enclosure 12 and the combustion chamber enclosure 14. This plenum (not numbered) includes air that is not in communication with one of the first and second air chambers 40, 42. In one example, the heated air within that plenum may be exhausted into the exhaust vent 112. In another example, the heated air within that plenum may be exhausted into one of the first or second vent assemblies 18, 20. In a yet further embodiment, a separate exhaust duct may be coupled to a panel of the outer enclosure 112 to provide the flow of heated air out of the plenum. A blower may be associated with such an additional exhaust duct to force heated air out of the plenum and exhaust that heated air to a remote location.

Referring now to FIGS. 7-13, another example fireplace assembly that illustrates the principles of the present invention is shown and described. Fireplace 200 includes an outer enclosure 212, a combustion chamber enclosure 214, and an airflow assembly 216. A top or a rear direct vent assembly 220, 222 may be used to provide combustion air and remove exhaust and exhaust gases from the fireplace 200. A combustion air channel 224 couples the combustion air provided by the direct vent assemblies 220, 222 to a combustion chamber 291 defined by a combustion chamber enclosure 214.

Figure 8:
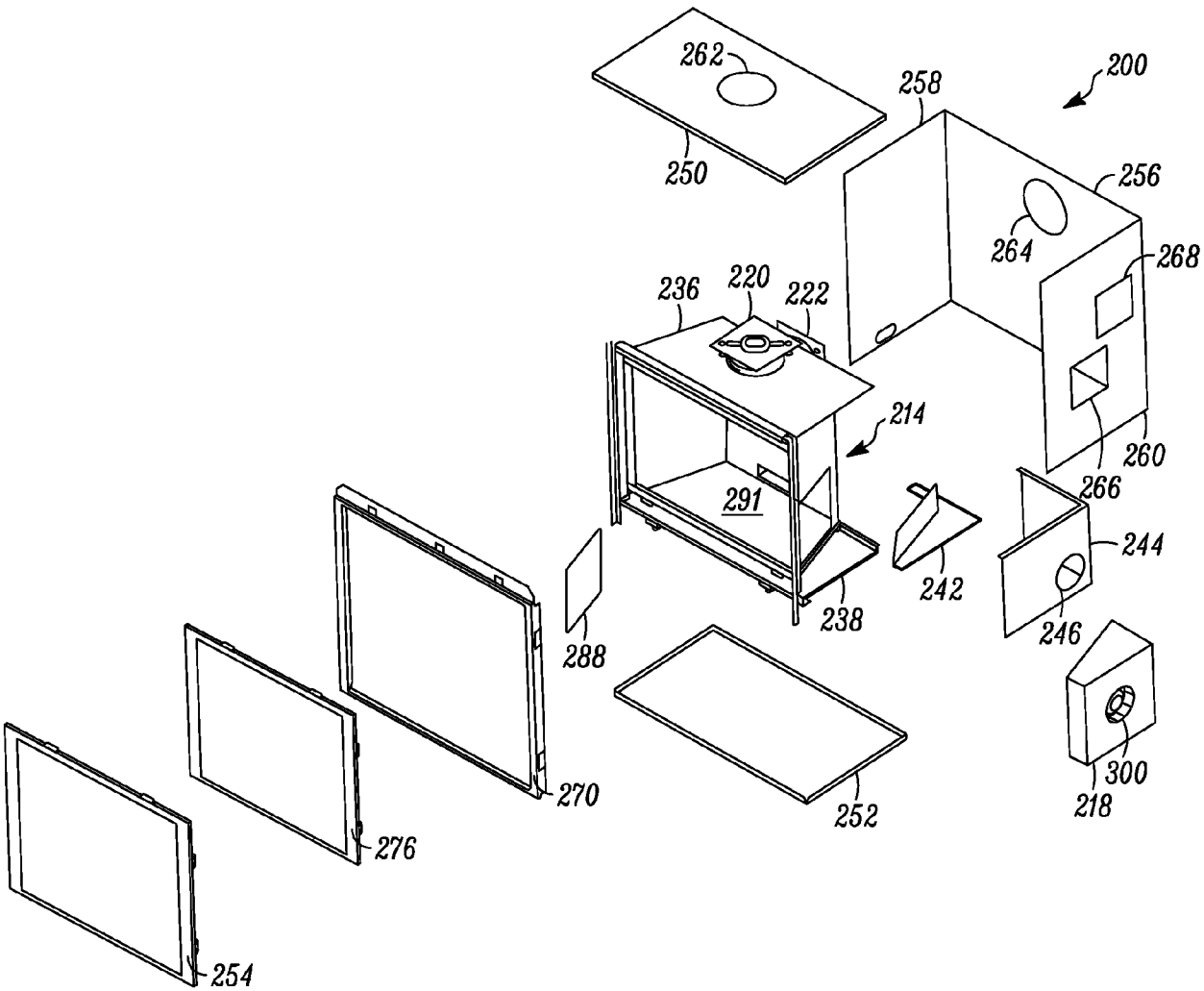
FIG. 8 is an exploded front perspective view of the fireplace assembly shown in FIG. 7.
Figure 9:
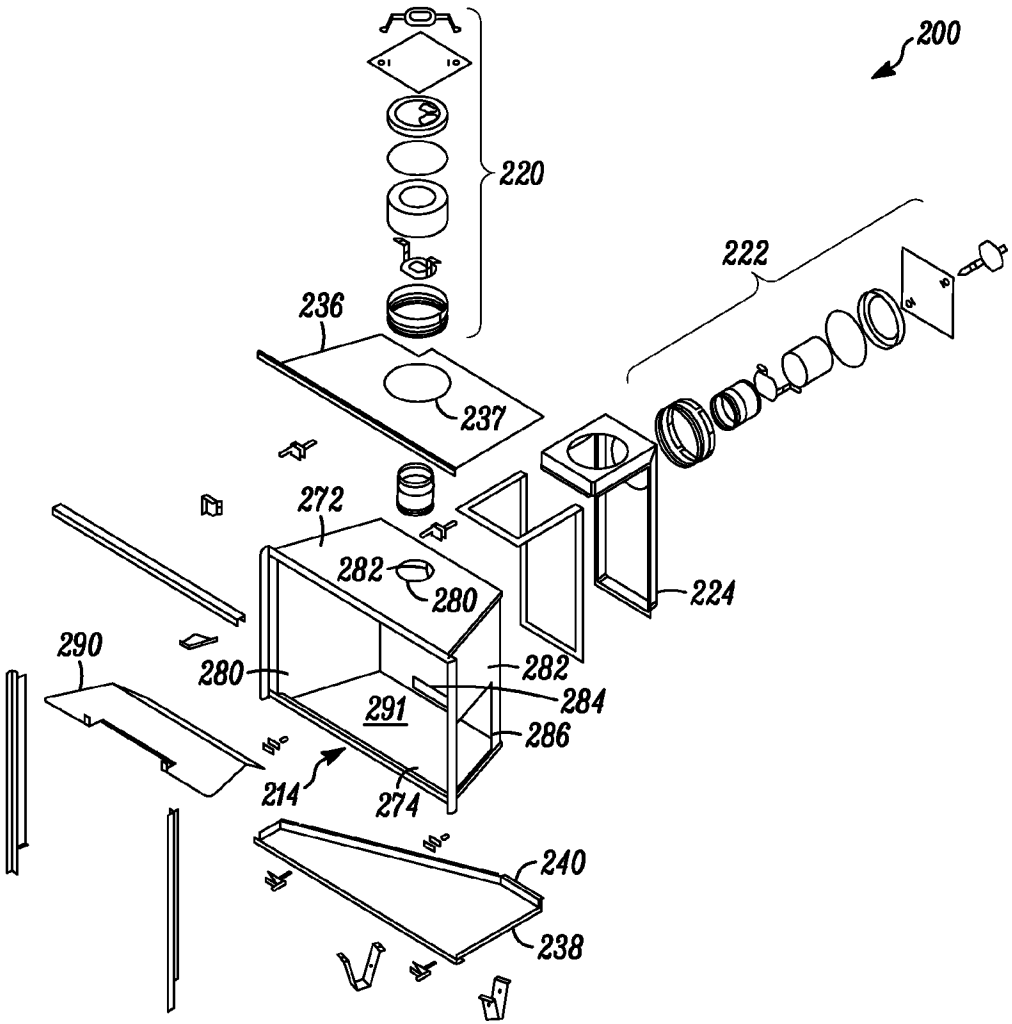
FIG. 9 is an exploded front perspective view of combustion chamber assembly and other features of the fireplace assembly shown in FIG. 7.

Referring to the FIG. 8, the airflow assembly 216 includes a blower 218, a top panel 236 having a vent opening 237, a bottom panel 238 having a side wall 240, a divider 242, and an exhaust panel 244 having an airflow exhaust opening 246. The airflow assembly 216 provides an airflow through a series of top, bottom and front airflow plenums 226, 228, 230 defined between the outer enclosure 212 and the combustion chamber enclosure 214. The intake source of air for the airflow may be at a remote location or may be from within the living space within which the fireplace 200 resides. Likewise, the exhaust outflow for the airflow may be a remote destination or may be the living space in which the fireplace 200 resides.

The outer enclosure 212 includes top and bottom panels 250, 252, front and rear panels 254, 256 and first and second side panels 258, 260. The outer enclosure 212 also includes a top vent opening 262 associated with the top direct vent assembly 220, a rear vent opening 264 associated with the rear direct vent assembly 222, an airflow intake opening 266, an airflow exhaust opening 268 and a front frame member 270. While the airflow intake and exhaust openings 266, 268 are shown formed in the second side panel 260, these openings 266, 268 may be positioned on opposing side panels or any combination of the top and bottom, rear, and first and second side panels 250, 252, 256, 258, 260. Likewise, the top and rear vent openings 262, 264 may also be formed in either of the side panels 258, 260.

The combustion chamber enclosure 214 includes top and bottom panels 272, 274, front and rear panels 276, 278, and first and second side panels 280, 282 that together define the combustion chamber 291. The front panel 276 and the front panel 254 of the outer enclosure 212 preferably include a transparent panel that provides viewing from outside of the fireplace 200 into the combustion chamber 291. Typically, a heat generating source such as a burner or electric heating element is positioned within the combustion chamber 291 along with an artificial or actual flame display. The combustion chamber enclosure 214 also includes top and rear vent openings 280, 282 associated with respective top and rear direct vent assemblies 220, 222, a combustion air opening 284 in fluid communication with the combustion air channel 224, a blower access opening 286, a blower opening panel 288, and a top vent shield 290.

Figure 12:
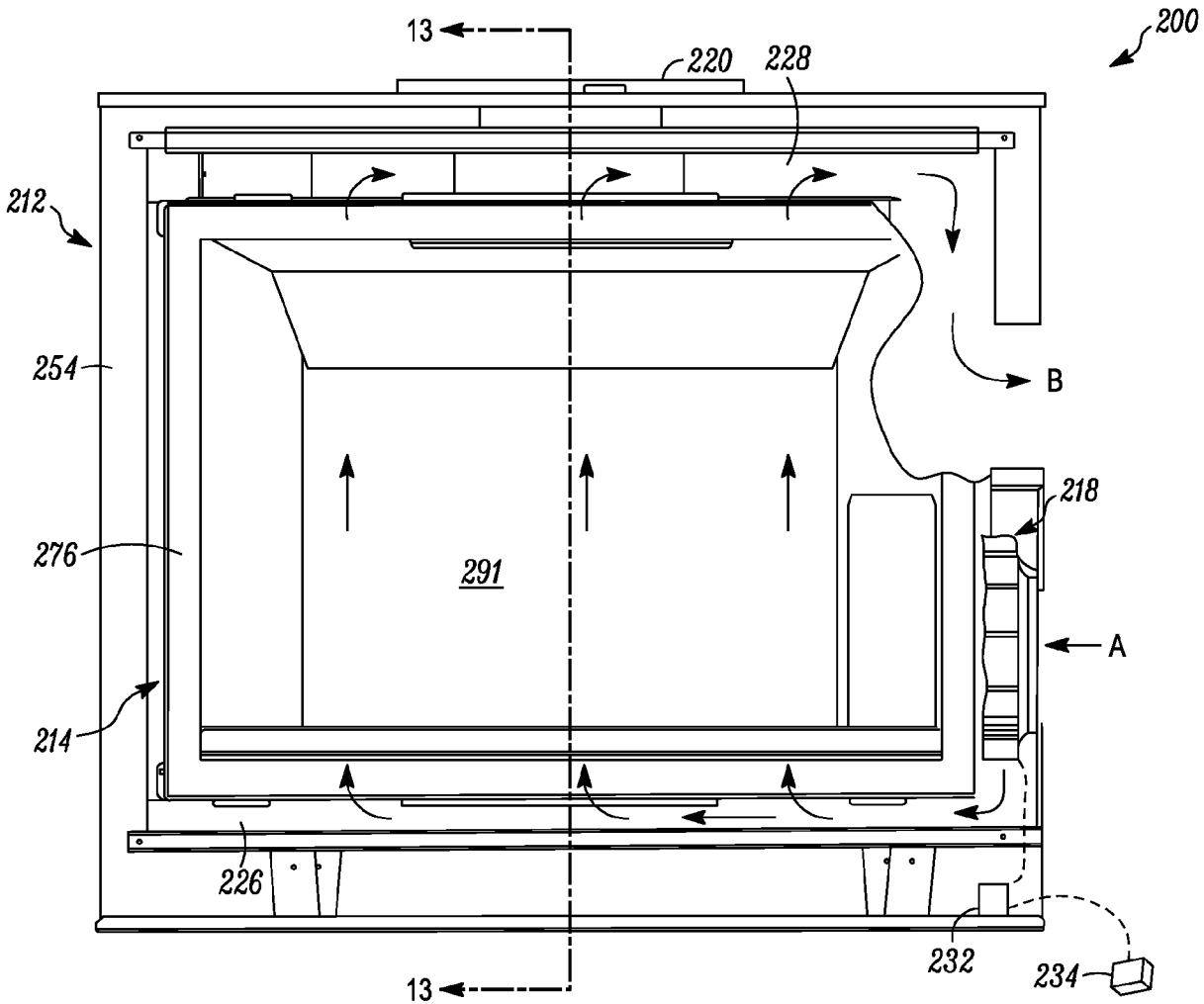
FIG. 12 is a front view of the fireplace assembly shown in FIG. 7.
Figure 13:
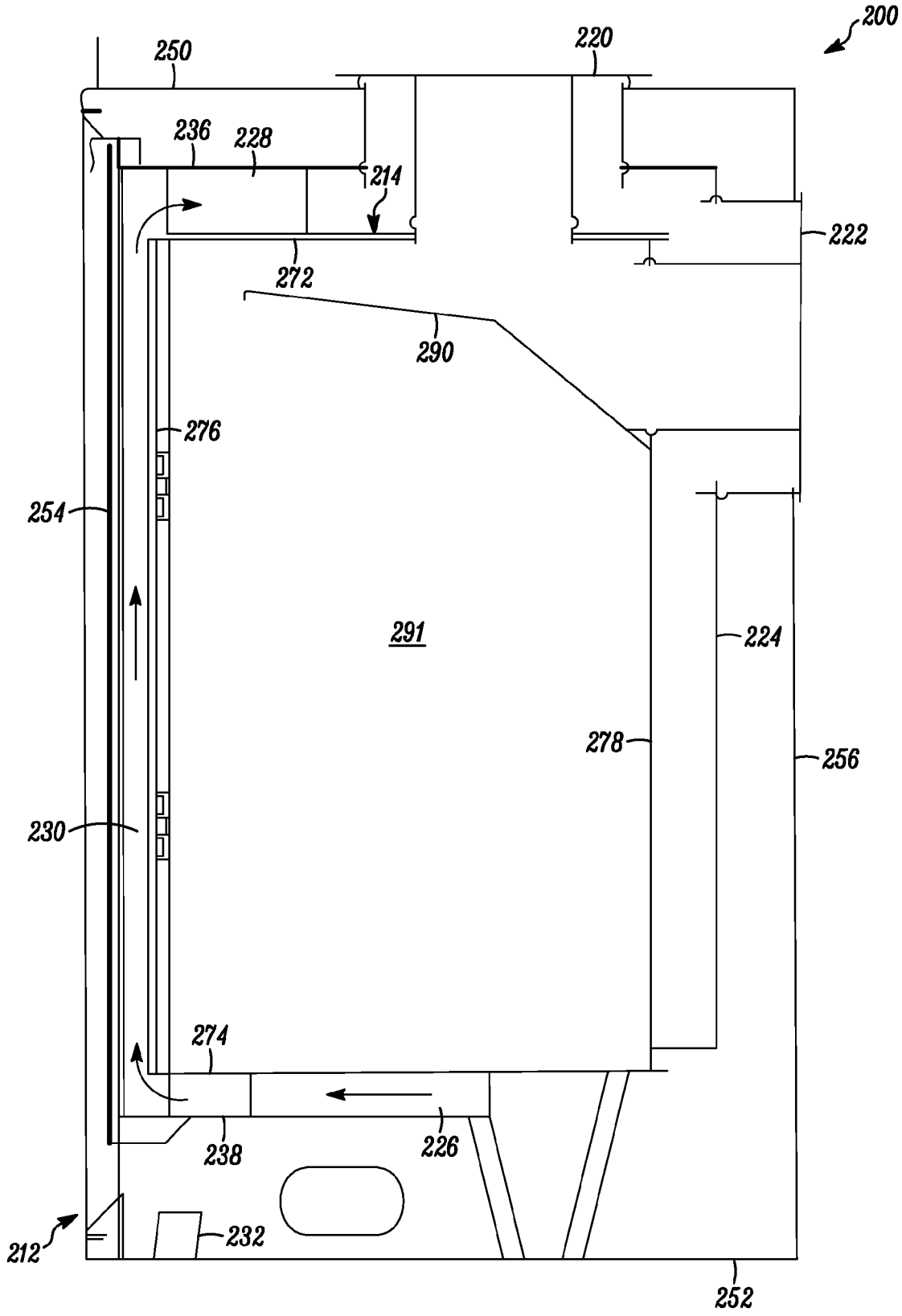
FIG. 13 is a cross-sectional view of the fireplace assembly shown in FIG. 12 taken along indicators 13-13.

As shown in FIGS. 12 and 13, the combustion chamber enclosure 214 is positioned within the outer enclosure and spaced apart from the outer enclosure a sufficient distance to help define the bottom, top and front airflow plenums 226, 228, 230. For example, the combustion chamber enclosure 214 is spaced rearward in the outer enclosure 212 a distance sufficient for a space or front airflow plenum 230 to be defined between the front panel 254 of the outer enclosure 212 and the front panel 276 of the combustion chamber enclosure 214. In another example, the combustion chamber enclosure 214 is spaced vertically lower from the top panel 250 of the outer enclosure 212 so that the top panel 236 of the airflow assembly 216 can be positioned there between and define the top airflow plenum 228 between the top panel 236 and the top panel 272 of the combustion chamber enclosure 214. In a third example, the combustion chamber enclosure 214 is spaced vertically above the bottom panel 252 of the outer enclosure 212 so that the bottom panel 238 of the airflow assembly 216 can be positioned there between. The bottom airflow plenum 226 is defined between the bottom panel 274 of the combustion chamber enclosure 214 and the bottom panel 238 of the airflow assembly 216.

Figure 11:
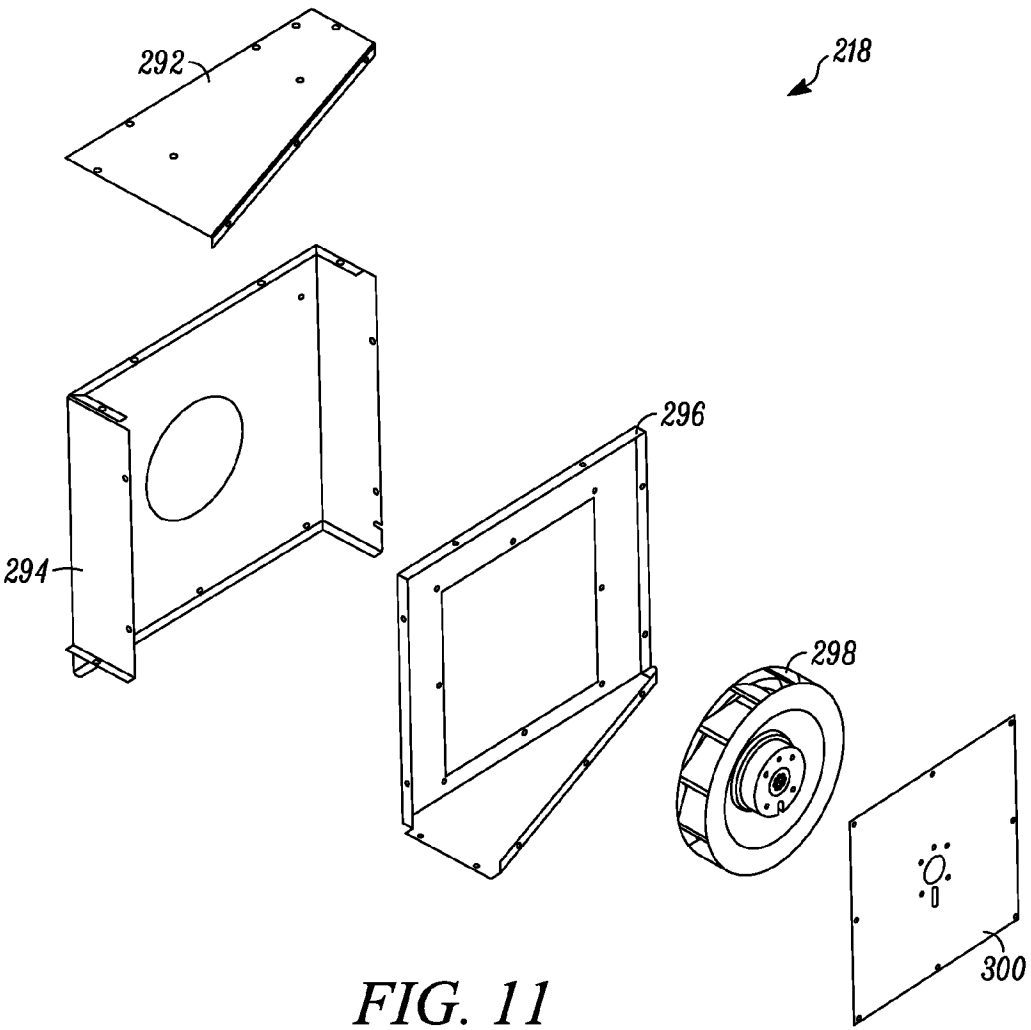
FIG. 11 is an exploded rear perspective view of the blower assembly shown in FIG. 10.
Figure 10:
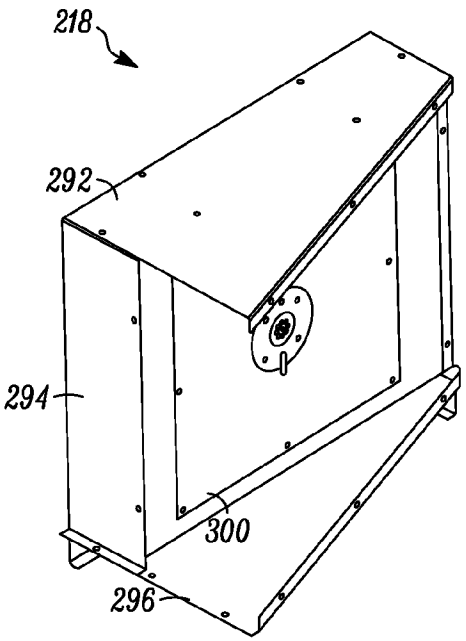
FIG. 10 is a rear perspective view of the blower assembly shown in FIG. 7.

The blower 218 of the airflow assembly 216 is shown in further detail in FIGS. 10 and 11. The blower 218 includes a top panel 292, an outer panel 294, an inner panel 296, a blower wheel 298, and an airflow intake opening 300. The airflow intake opening 300 provides an inlet air opening for intake airflow A (see FIG. 12), wherein the airflow is accelerated by the blower wheel 298 and forced into the bottom airflow panel 226 (see FIGS. 12 and 13). The bottom panel 238 of the airflow assembly 216 includes a side wall 240 that helps direct the airflow in the bottom airflow plenum 226 toward a front of the fireplace 200 where an opening to the front airflow plenum 230 is provided between the front panels 254, 280. As the airflow passes through the front airflow plenum 230, the airflow absorbs radiant heat passing from the combustion chamber 291 through the front panel 276 of the combustion chamber enclosure 214 while at the same time removing heat from the front panel 254, thereby cooling the front panel 254. Thus, by passing the airflow through the front airflow plenum 230, the front panel 254, which is exposed within the living space in which the fireplace 200 resides, can be cooled while at the same time controlling the amount of radiant heat passing from the combustion chamber 291 through the front panels 254, 276 to the living space.

The airflow moves from the front airflow plenum 230 into the top airflow plenum 228. The top airflow plenum 228 is defined across a portion of the top panel 272 of the combustion chamber enclosure 214 and may also extend around a portion of the top direct vent assembly 220 and the combustion air channel 224. In some embodiments, the top airflow plenum 228 may extend around the combustion chamber enclosure 214 to the plenum space defined between the rear panel 278 of the combustion chamber enclosure 214 and the rear panel 256 of the outer enclosure 212. The divider 242 and exhaust panel 244 define an airflow path from the top airflow plenum 228 towards the airflow exhaust opening 246.

The airflow exhaust opening 246 may be coupled to any desired location via some type of exhaust or vent passage. For example, the heated airflow exiting the airflow exhaust opening 246 may be transferred to the living space in which the fireplace 200 resides, to another location within the living structure but outside of the living space within which the fireplace 200 directly resides, or to a location outside of the living structure altogether. In one example, the temperature of the living space can be closely controlled by varying the blower speed to control the amount of heat output from the fireplace 200 into the living space without altering the rate of heat generation in the combustion chamber. One example of this type of control is possible when the airflow intake opening 300 of the blower 218 is coupled to a source of outside fresh air (air outside of any living structure) and the airflow exhaust opening 246 is coupled to atmospheric air outside of the living structure as well.

One advantage of the example configuration shown in FIGS. 7-13 is that the blower 218 can be automatically controlled to help maintain a predetermined temperature in the living space. For example, the controller 232 can control of the blower speed based on a user input. The user input may come via a thermostat setting or from a temperature input signal provided by a thermostat 234 that is positioned within the living space. The thermostat may be mounted within or otherwise associated directly with the fireplace 200. In some embodiments, the thermostat may directly control the blower without the intervening controller 232. The controller may be integrated into a thermostat in some embodiments.

The blower speed may be reduced in order to increase the temperature of the living space in order to meet a predetermined temperature set by the thermostat, or the blower speed may be increased in order to reduce a temperature in living space until it meets the predetermined temperature set with the thermostat 234. In some embodiments, the blower maintains an on state when a predetermined temperature exists in the combustion chamber 291. For example, the blower may automatically turn on after a predetermined time period after combustion (or other heat generation) is initiated in the combustion chamber 291. Likewise, the blower may automatically turn off after a predetermined time period after combustion (or heat generation) ends in the combustion chamber 291.

In still further embodiments, the temperature of the exposed front panel 254 is monitored and the blower is controlled (e.g., on/off or increase/decrease blower speed) based on the monitored temperature. In one example, the blower is turned on after a threshold temperature of the panel 254 is reached and is incrementally increased in speed as the temperature continues to increase. Likewise, the blower may be decreased in speed as the monitored temperature of the panel 254 is reduced in temperature and eventually turned off when the panel temperature drops below a threshold temperature.

The airflow through the plenums 226, 228, 230 may also help cool the combustion air channel 224 and thus help maintain a cooler temperature of the incoming combustion air. In many situations, it is preferred to have relatively cool combustion air entering the combustion chamber 291 for improved combustion efficiency. A still further advantage of fireplace 200 is that the intake airflow and exhaust airflow B can be coupled to any desired source or location. This provides improved adaptability of the fireplace 200 for the user to provide certain airflow and heating scenarios within the living structure.

In some embodiments, the blower 218 may be positioned outside of the outer enclosure 212 and still provide the same or similar function of forcing the airflow through (pushing force) the fireplace 200 or for drawing the airflow through (pulling force) the fireplace 200. In one example embodiment, the blower is positioned at the termination point of either the intake or exhaust line that is fed to the fireplace 200. Positioning the blower at a remote location may be advantageous for reducing noise output of the fireplace 200. In other embodiments, more than one blower may be used to move the airflow. In still further embodiments, other blowers may be used to move fluids into or out of the combustion chamber 291 or to move air through plenum spaces defined between the outer enclosure 212 and the vent panels 236, 238.

Another advantage of fireplace 200 is that it provides cooling of front panel 254 of the outer enclosure. Cooling of the front panel 254 improves the safety of fireplace 200 and reduces the likelihood of harm caused to persons in close proximity to the fireplace 200 while the fireplace is in use.

The airflows A, B (see FIG. 12) that pass through the fireplace 200 may be part of a closed ventilation system that is fluidly separated from air within the living structure wherein the fireplace 200 resides. This closed system can be maintained if the source for the airflow A is atmosphere outside the living structure and the exhaust location for the airflow B is also atmosphere outside the living structure. In some circumstances, it is advantageous to maintain separation of the airflows A, B so that the pressure condition of the living structure is not affected by the fireplace 200.

In an alternative embodiment (not shown), the fireplace 200 may include at least one door in place of front panel 254 that provides access to the front plenum 230. The door may be automated according to principles discussed in U.S. patent application Ser. No. 10/794,424 discussed above. In other embodiments, the fireplace 200 may include damper or other variable position members that provide variable flow control of room air into the airflows A, B.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A heating appliance, comprising:

an outer enclosure including a front panel having a transparent portion;

a combustion chamber enclosure positioned within the outer enclosure and defining a combustion chamber wherein radiant heat is generated, the combustion chamber enclosure including a front panel having a transparent portion; and a variable speed blower configured to generate an adjustable airflow between the outer enclosure front panel and the combustion chamber enclosure front panel and exhaust the airflow to a location remote from a living space in which the heating appliance is exposed;

wherein the airflow absorbs at least some of the radiant heat and varying a speed of the blower controls an amount of radiant heat transferred from the combustion chamber to the living space, and the airflow is separated from the living space and the combustion chamber, wherein the combustion chamber is sealed from the adjustable airflow.

2. The heating appliance of claim 1, wherein the airflow alters a temperature of the front panel of the outer enclosure.

3. The heating appliance of claim 1, wherein increasing the blower speed reduces the amount of radiant heat transferred through the front panel of the outer enclosure.

4. The heating appliance of claim 1, further comprising a controller configured to vary the blower speed based on a thermostatic reading from within the living space.

5. The heating appliance of claim 1, wherein the blower is positioned within the outer enclosure.

6. The heating appliance of claim 5, wherein the blower is positioned adjacent to a side panel of the combustion chamber enclosure.

7. The heating appliance of claim 1, wherein a path of the airflow extends from a bottom side of the combustion chamber, between the front panels of the outer enclosure and the combustion chamber enclosure, and over a top side of the combustion chamber enclosure.

8. The heating appliance of claim 1, wherein an inlet opening for the airflow to enter the outer enclosure and an exhaust opening for the airflow to exit the outer enclosure are each positioned on a side panel of the outer enclosure.

9. The heating appliance of claim 1, further comprising a top airflow panel positioned between a top panel of the combustion chamber enclosure and a top panel of the outer enclosure, and the top airflow panel defines an upper plenum for the airflow between the top panel of the combustion chamber enclosure and the top airflow panel.

10. The heating appliance of claim 9, further comprising a bottom airflow panel positioned between a bottom panel of the combustion chamber enclosure and a bottom panel of the outer enclosure, and the bottom airflow panel defines a lower plenum for the airflow between the bottom panel of the combustion chamber enclosure and the bottom airflow panel.

11. The heating appliance of claim 1, further comprising an interior panel positioned between and in parallel with the front panels, the interior panel defining first and second air spaces between the front panels, the first and second air spaces being sealed from each other and from the combustion chamber, and respective first and second airflows move through the first and second air spaces.

12. The heating appliance of claim 11, wherein the outer enclosure front panel includes at least one door providing access into the first air space.

13. The heating appliance of claim 11, wherein portions of the interior panel, the combustion chamber enclosure front panel, and the outer enclosure front panel are transparent.

14. The heating appliance of claim 11, further comprising a first exhaust vent configured to exhaust the first airflow from the first air space and a second exhaust vent configured to exhaust the second airflow from the second air space, a first blower coupled to the first air space and configured to move the first airflow air out of the first exhaust vent and a second blower coupled to the second air space and configured to move the second airflow out of the second exhaust vent.

15. The heating appliance of claim 14, wherein the first exhaust vent is configured to be adjustable between exhausting the first airflow into the living space and exhausting the first airflow to a remote location.

16. The heating appliance of claim 1, further comprising an air chamber defined by a rear panel of the outer enclosure and a rear panel of the combustion chamber.

17. The heating appliance of claim 16, further comprising an exhaust vent in fluid communication with the air chamber.

18. The heating appliance of claim 17, further comprising a blower in fluid communication with the air chamber, wherein the blower is configured to force air from the air chamber through the exhaust vent.

19. The heating appliance of claim 1, wherein the blower is positioned at a location outside the outer enclosure.

20. A heating appliance, comprising:

an outer enclosure including a front panel having a transparent portion;

a combustion chamber enclosure positioned within the outer enclosure and defining a combustion chamber wherein radiant heat is generated, the combustion chamber enclosure including a front panel having a transparent portion;

a variable speed blower configured to generate an adjustable airflow between the outer enclosure front panel and the combustion chamber enclosure front panel and exhaust the airflow to a location remote from a living space in which the heating appliance is exposed such that increasing the blower speed reduces the amount of radiant heat transferred through the front panel of the outer enclosure; and a controller configured to vary the blower speed based on a thermostatic reading from within the living space;

wherein the airflow absorbs at least some of the radiant heat and the airflow is separated from the combustion chamber, wherein the combustion chamber is sealed from the adjustable airflow.

21. The heating appliance of claim 20, further comprising an air chamber defined by a rear panel of the outer enclosure and a rear panel of the combustion chamber.

22. The heating appliance of claim 21, further comprising an exhaust vent in fluid communication with the air chamber.

23. The heating appliance of claim 22, further comprising a blower in fluid communication with the air chamber, wherein the blower is configured to force air from the air chamber through the exhaust vent.

24. The heating appliance of claim 20, wherein the blower is positioned at a location outside the outer enclosure.

* * * * *